US005769000A

United States Patent [19]

Dunfey

[11] Patent Number: 5,769,000

[45] Date of Patent: Jun. 23, 1998

[54] UMBRELLA TABLE HAVING A BUILT-IN LIGHT SOURCE

[75] Inventor: Sean M. Dunfey, Falmouth, Me.

[73] Assignee: Downeast Woodworks, Inc., Falmouth, Me.

[21] Appl. No.: 786,678

[22] Filed: Jan. 21, 1997

[51] Int. Cl.[6] ..... A47B 85/00

[52] U.S. Cl. ..... 108/23; 108/50

[58] Field of Search ..... 108/23, 50; 431/311, 431/320; 362/410, 415, 161, 447

[56] References Cited

U.S. PATENT DOCUMENTS

| | | | |
|---|---|---|---|
| 654,878 | 7/1900 | De Zeng | 362/415 X |
| 1,051,760 | 1/1913 | Redlich | 362/415 |
| 1,653,256 | 12/1927 | Davis | 362/415 |
| 1,846,878 | 2/1932 | Kopp | 108/23 X |
| 2,090,248 | 8/1937 | Chakow | 108/23 |
| 2,261,514 | 11/1941 | Dunigan | 108/23 X |
| 3,624,381 | 11/1971 | Pollack | 108/23 |
| 3,642,732 | 2/1972 | Bowden | 108/50 |
| 4,380,200 | 4/1983 | Reninger | 108/23 |
| 4,623,367 | 11/1986 | Paulson | 108/50 X |
| 5,541,824 | 7/1996 | Perkins | 362/415 X |

FOREIGN PATENT DOCUMENTS

| | | | |
|---|---|---|---|
| 193800 | 1/1938 | Switzerland | 108/23 |

*Primary Examiner*—Jose V. Chen
*Attorney, Agent, or Firm*—Frederick R. Cantor, Esq.

[57] ABSTRACT

An outdoor umbrella table can be equipped with a modified central post structure that forms a protective cage for a kerosene lamp light source. The flame generated by the kerosene lamp provides sufficient illumination of the table top surface as to permit use of the table during non-daylight hours.

19 Claims, 2 Drawing Sheets

UMBRELLA TABLE HAVING A BUILT-IN LIGHT SOURCE

BACKGROUND AND SUMMARY OF THE PRESENT INVENTION

This invention relates to an outdoor umbrella table having a built-in light source. In preferred practice of the invention the light source is a kerosene lamp mounted on the central post that supports the umbrella.

The broad concept of incorporating electric lights into an umbrella is disclosed in various issued patents. However, none of the prior art patents show the specific arrangement of the present invention.

U.S. Pat. 5,463,535, to W. Vest, discloses an umbrella table having a cylindrical lens 70 built into the central post. An electric light bulb 42 (FIG. 9) is located within the hollow lens. Lens 70 would have to be built of a very high strength material to withstand expected forces.

U.S. Pat. 5,053,931, to J. Rushing, shows an umbrella table wherein miniature Christmas tree lights 14 are attached to the umbrella ribs 28. The intent apparently is to have large numbers of miniature lights that will collectively provide a sufficient total illumination effect. The arrangement requires the use of an extension cord leading back to the household current supply.

U.S. Pat. 4,174,532, to R. Kelley, shows a portable lighting fixture that can be intermittently (occasionally) mounted on a conventional umbrella table. The fixture comprises one or more light bulbs mounted on a circular plate 5. The plate has a radial slot that allows the plate to be inserted onto the central post in the space above the umbrella ribs.

Schiavone 3,313,929, shows a fluorescent lamp 22 plugged into sockets 23 and 26 that are built into the upper end of an umbrella post. This arrangement requires the use of an extension cord (as is the case with many of the prior art arrangements).

Finkel 2,087,537, is generally similar to the above-mentioned patent 4,174,532 to Kelley, except that the light bulb system is permanently mounted at the upper end of the umbrella post.

U.S. Pat. 5,331,524, to C. Tseng, shows another umbrella table having a light fixture built into the upper end of the central post. This patent is believed to be generally similar to the above-discussed patents 3,313,929 and 2,087,537.

The present invention relates to an outdoor umbrella table having a self-contained light source, whereby the table can be used during the non-daylight hours; the use of an extension cord is not required to energize the light source. The central post that supports the umbrella includes an upper post section having a self-contained cage structure for supporting a hurricane lamp. This cage structure can comprise upper and lower plates (disks) joined together by a series of circumferentially spaced vertical rods. The lamp is located on the post centerline within the cage structure. In preferred practice of the invention the cage structure is located slightly below eye level a few inches above the table surface, such that people sitting at the table can see each other across the table without visual obstruction by the lamp. The cage structure can be designed so that the lower plate has a hollow reservoir for kerosene that is used to power the lamp.

In an alternative arrangement the light source can be a battery-powered light, or one or more candles.

Specific features of the invention will be apparent from the attached drawings and accompanying description of preferred embodiments of the invention.

In summary, and in accordance with the above discussion, the foregoing objectives are achieved in the following embodiments.

1. An umbrella table comprising a table top and a tubular guide extending downwardly from said top; and an upstanding post structure removably supported in said tubular guide; said post structure comprising a lower tube having an upper end, a lower disk radiating from the upper end of said lower tube, an upper tube having a lower end, an upper disk radiating from the lower end of said upper tube, and a plurality of vertical rods extending between said upper and lower disks; and a light source located within a central space circumscribed by said vertical rods.

2. The umbrella table, as described in paragraph 1, wherein said light source is a kerosene lamp.

3. The umbrella table, as described in paragraph 1, wherein said light source is a hurricane lamp having a kerosene fuel supply.

4. The umbrella table, as described in paragraph 1, wherein said light source is a kerosene lamp that includes a kerosene fuel supply cup located in the upper end of said lower tube.

5. The umbrella table, as described in paragraph 4, wherein said kerosene lamp further includes a tubular shroud extending upwardly from said fuel supply cup and a wick extending from said cup upwardly through said tubular shroud.

6. The umbrella table, as described in paragraph 5, and further comprising a transparent globe encircling said tubular shroud to confine the flame at the upper end of said wick.

7. The umbrella table, as described in paragraph 1, wherein one of said vertical rods is removable.

8. The umbrella table, as described in paragraph 7, wherein said lower disk has a first socket receiving the lower end of said one vertical rod, and said upper disk has a second socket receiving the upper end of said one vertical rod; and said second socket having a vertical depth that is greater than the penetration depth of said one rod, whereby said one rod can be removed by a lifting and tilting motion.

9. The umbrella table, as described in paragraph 1, wherein there are six circumferentially spaced vertical rods located equidistant from a central axis defined by said upper and lower tubes; said light source comprising a kerosene lamp having a kerosene fuel supply cup located in the upper end of said lower tube; and one of said vertical rods being removable to permit access to the kerosene lamp.

10. The umbrella table, as described in paragraph 9, wherein said lower disk has a first socket receiving the lower end of said one vertical rod, and said upper disk has a second socket receiving the upper end of said one vertical rod; and said second socket having a vertical depth that is greater than the penetration depth of said one rod, whereby said one rod can be removed by a lifting and tilting motion.

11. The umbrella table, as described in paragraph 9, and further comprising a transparent globe encircling said post structure; and said globe having a lower end adapted to rest on said table top and an upper end locatable above the plane of said upper disk whereby said globe is adapted to surround said circumferentially spaced rods.

12. An umbrella table comprising a table top and a tubular guide extending downwardly from said top; and an upstanding post structure removably supported in said tubular guide; said post structure comprising a lower tube, an upper tube, and a cage located between said tubes; and a kerosene lamp disposed within said cage.

13. The umbrella table, as described in paragraph 12, wherein said cage is located a relatively slight distance above said table top; and said cage comprising an upper disk, a lower disk, and a plurality of vertical rods extending between said disks.

14. In an umbrella table that includes a table top, a tubular guide extending downwardly from said top, and an upstanding sectional post structure removably supported in said tubular guide, the improvement comprising:

an insert telescopically insertable between upper and lower sections of said post structure; said insert comprising a lower tube having an upper end, a lower disk radiating from the upper end of said lower tube, an upper tube having a lower end, an upper disk radiating from the lower end of said upper tube, and a plurality of vertical rods extending between said upper and lower disks; and a light source located within the central space circumscribed by said vertical rods.

15. The improvement, as described in paragraph 14, wherein said light source is a kerosene lamp.

16. The improvement, as described in paragraph 14, wherein said light source is a kerosene lamp having a self-contained kerosene fuel supply.

17. The improvement, as described in paragraph 16, wherein said fuel supply is located in the upper end of said lower tube.

18. The improvement, as described in paragraph 17, wherein one of said vertical rods is removable; said lower disk having a first socket receiving the lower end of said one vertical rod, and said upper disk having a second socket receiving the upper end of said one vertical rod; said second socket having a vertical depth that is greater than the penetration depth of said one vertical rod, whereby said one vertical rod can be removed by a lifting and tilting motion.

BRIEF DESCRIPTION OF THE DRAWINGS

FIG. 2, is taken in the direction of arrow 2 in FIG. 1.

DESCRIPTION OF THE PREFERRED EMBODIMENTS OF THE PRESENT INVENTION

Figure 1:
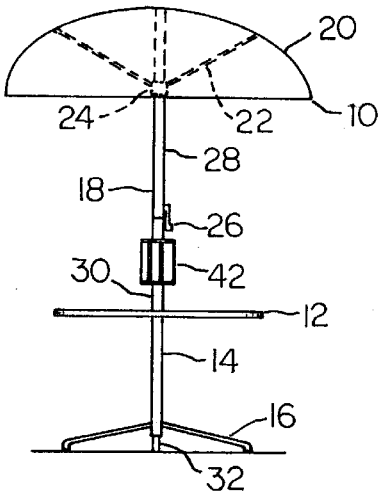
FIG. 1, is an elevational view of an outdoor umbrella table embodying the invention.

FIG. 1, is an elevational view of an outdoor umbrella table embodying the invention.

Referring to FIG. 1, there is shown an outdoor umbrella table 10 that includes a circular table top 12 affixed to an upstanding tubular guide 14 that is supported by four radial feet 16. A tubular post structure 18 extends vertically and through guide 14 to provide a central support for an overhead umbrella 20.

The umbrella can be a collapsible (foldable) fabric attached to plural radial struts 22 that radiate from a slidable ring 24 encircling post structure 18. A hand crank 26 is rotatably mounted on the post structure for operating an internal cord system attached to ring 24, whereby the crank can be rotated in one direction to raise ring 24, and in the opposite direction to lower ring 24. The ring moves up and down on post structure 18 to fold or unfold umbrella 20.

Post structure 18 is a sectional tubular construction that comprises an upper section 28, central section 30, and lower section 32. These three sections telescope together to form the post structure 18 depicted in FIG. 1.

Figure 2:
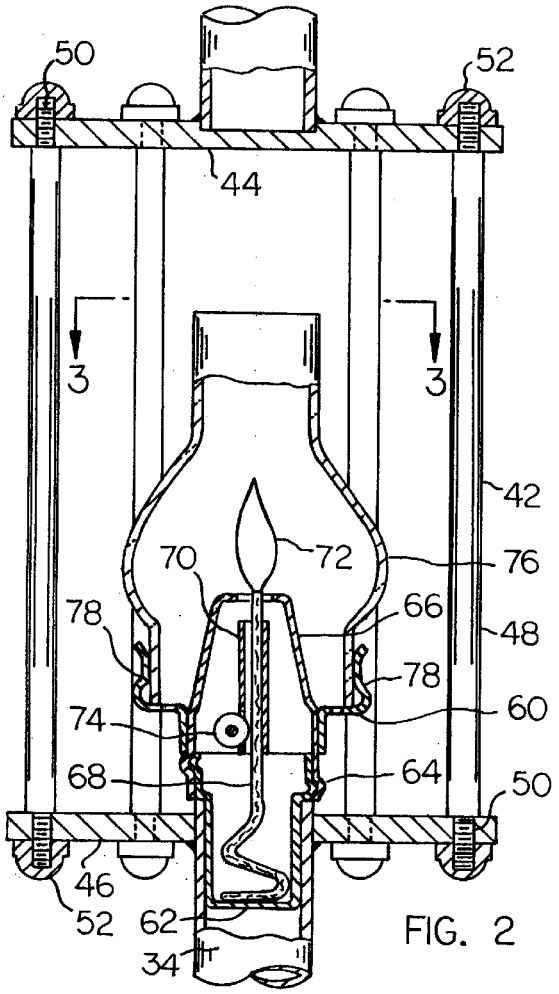
FIG. 2, is an enlarged view of a cage structure and lamp incorporated into the FIG. 1 umbrella table.
Figure 3:
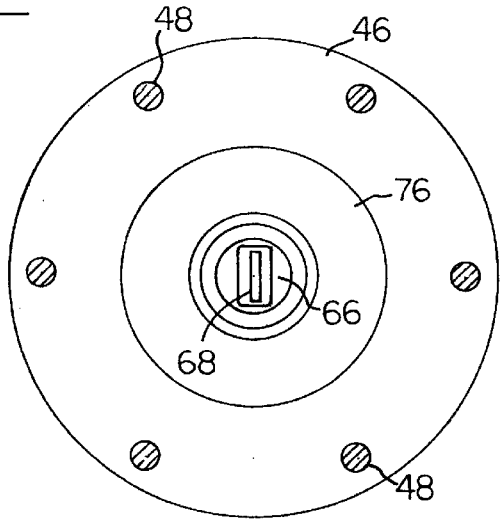
FIG. 3, is a transverse sectional view taken on line 3—3 in FIG. 2.
Figure 5:
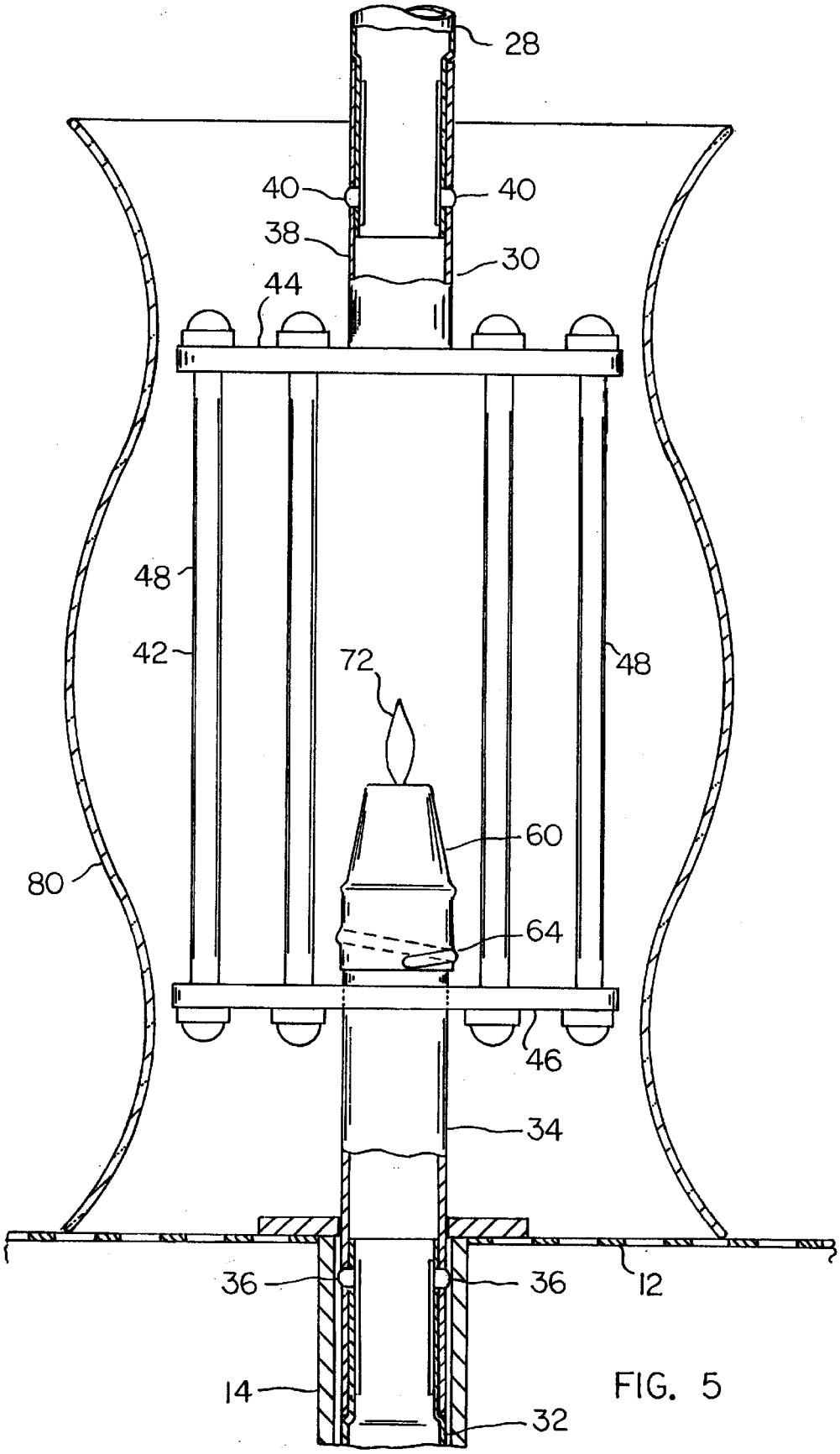
FIG. 5, is a view taken in the same direction as FIG. 2, but showing a transparent globe around the lamp cage.

FIG. 5, is a view taken in the same direction as FIG. 2, but showing a transparent globe around the lamp cage.

The invention is concerned primarily with the central post section 30. As shown in FIG. 5, central post section 30 comprises a lower tube 34 having its lower end portion telescoped onto the lower post section 32; conventional bullet-type latches 36 are used to releasably lock tube 34 to post section 32.

Central post section 30 further comprises an upper tube 38 that has its upper end telescoped onto the lower end of upper post section 28; conventional bullet-type latches 40 are used to releasably lock tube 38 to post section 28. Tubes 34 and 38 are rigidly joined together by a lamp cage 42.

Cage 42 comprises an upper circular disk 44 attached to the lower end of tube 38, a lower circular disk 46 attached to the upper end of tube 34, and six vertical rods 48 extending between the two disks. Five of the six rods are rigidly affixed to disks 44 and 46; the remaining rod is removable, for the purpose of gaining access to the cage interior space.

FIG. 2, is an enlarged view of a cage structure and lamp incorporated into the FIG. 1 umbrella table. FIG. 2, is taken in the direction of arrow 2 in FIG. 1.

FIG. 2, illustrates one method of rigidly attaching a rod 48 to disks 44 and 46. Each threaded rod end 50 is extended through a smooth-surfaced hole in the disk, 44 or 46, into a threaded nut 52. After the nut 52 has been threaded onto the threaded rod end the nut can be welded to the associated disk 44 or 46, to achieve a permanent connection of the rod 48 to the disk.

Figure 4:
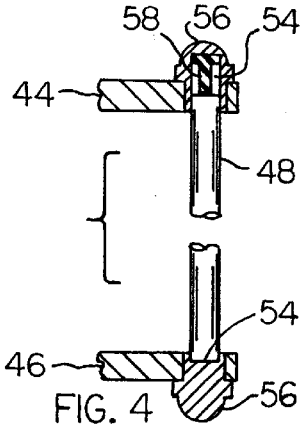
FIG. 4, is an elevational view of a removable rod used in a lamp cage incorporated into the FIG. 1 umbrella table.

FIG. 4, is an elevational view of a removable rod used in a lamp cage incorporated into the FIG. 1 umbrella table.

FIG. 4, shows an arrangement for removably mounting the sixth rod 48. Only one of the six rods is removable; the other five rods are permanently joined to disks 44 and 46 in order to achieve a high strength post construction. The single removable rod can be located at any point around the disk circumference.

Referring to FIG. 4, the removable rod 48 has smooth-surfaced rod ends adapted to have slip-fit positionments in sockets 54 in disks 44 and 46. Each socket 54 is closed by a plug 56 that has the same ornamental appearance as the nuts 52 used to affix the other five rods to the disks. The cage structure has a symmetrical appearance that is attractive for ornamental purposes; however one of the six rods can be removed when it becomes necessary to gain access to the cage interior space.

As shown in FIG. 4, the uppermost socket 54 is deeper (axially) than the penetration distance of the rod end into the socket. Consequently the rod can be lifted into the upper socket and out of the lower socket, after which the rod can be tilted to clear the edge of the lower disk 44, so as to permit the rod to be drawn out of the upper socket. A compressible cushion 58 may be provided in the upper socket to prevent the removable rod from rattling.

The lowermost socket 54 has an internal rod support surface, whereas the uppermost socket 54 has an internal roof surface that carries the compressible cushion 58. The vertical distance between the rod support surface in the lowermost socket and the internal roof surface in the uppermost socket is greater than the axial length of the removable rod 48 so that the rod can be removed from its support position when necessary.

Referring to FIG. 2, there is shown a kerosene lamp 60 located in the space circumscribed by rods 48. Lamp 60 is a generally conventional hurricane lamp construction, modified for fixed disposition within cage 42. As shown in FIG. 2, the lamp 60 comprises a kerosene fuel supply cup 62 having a threaded connection 64 with an upstanding tubular shroud 66. A wick 68 extends upwardly from cup 62 through a guide tube 70 and a slot-like opening in the upper end of the shroud 66. The kerosene-soaked wick can be ignited with a match, to produce a flame 72. Periodically the wick can be advanced upwardly by manually rotating a wheel (knob) attached to the shaft of a drive roller 74.

The kerosene lamp 60 has an optional transparent globe 76 adapted to encircle shroud 66, whereby the flame is prevented from burning the hands of persons seated at the table. Globe 76 can be held in place by means of an annular clip means 78 that has a frictional fit on shroud 66. The height of globe 76 is less than the available space between disks 44 and 46, such that the globe can be lifted out of cage 42 when it becomes necessary to light the lamp or add fuel to cup 62. Shroud 66 can be unscrewed from the cup 62 to gain access to the cup. Also, cup 62 can be lifted out of tube 34 when it becomes necessary to clean, or replace, the cup.

FIG. 2, shows the kerosene lamp 60 equipped with an ornamental-protective globe 76 located within cage 42. FIG. 5, shows an alternate arrangement that utilizes a larger transparent globe 80 encircling cage 42 and post structure 30. The lower end of globe 80 rests on table top 12, such that openings in expanded metal table top 12 form air supply passages for combustion air needed to support flame 72. The upper end of the globe 80 is located above the plane of disk 44, so as to achieve an ornamental and protective function. When globe 80 is used, it is not necessary to use the annular clip means 78.

The post structure is designed so that cage 42 is spaced a relatively slight distance above table top 12, whereby the flame 72 provides relatively good illumination of the table surface. The illumination source (lamp 60) is non-electric; therefore an extension cord is not required to provide an operative system in locations remote from a household current supply.

As noted earlier, the invention is concerned primarily with the central post section 30, i.e. the assembly that includes lower tube 34, upper tube 38, and lamp cage 42. The invention is further concerned with the features that enable the kerosene lamp to be built into the cage structure while permitting the lamp components to be accessed and removed when necessary.

Post sections 28 and 32 can be conventional post sections used in conventional umbrella tables. The thrust of the present invention is to incorporate a caged kerosene lamp into an otherwise conventional umbrellasupport post structure.

The present invention, described above, relates to an umbrella table having a built-in light source. Features of the present invention are recited in the appended claims. The drawings contained herein necessarily depict structural features and embodiments of the umbrella table having a built-in light source, useful in the practice of the present invention.

However, it will be appreciated by those skilled in the arts pertaining thereto, that the present invention can be practiced in various alternate forms, proportions, and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. An umbrella table comprising a table top and a tubular guide extending downwardly from said top; and an upstanding post structure removably supported in said tubular guide; said post structure comprising a lower tube having an upper end, a lower disk radiating from the upper end of said lower tube, an upper tube having a lower end, an upper disk radiating from the lower end of said upper tube, and a plurality of vertical rods extending between said upper and lower disks; and a light source located within a central space circumscribed by said vertical rods.

2. The umbrella table, as described in claim 1, wherein said light source is a kerosene lamp.

3. The umbrella table, as described in claim 1, wherein said light source is a hurricane lamp having a kerosene fuel supply.

4. The umbrella table, as described in claim 1, wherein said light source is a kerosene lamp that includes a kerosene fuel supply cup located in the upper end of said lower tube.

5. The umbrella table, as described in claim 4, wherein said kerosene lamp further includes a tubular shroud extending upwardly from said fuel supply cup and a wick extending from said cup upwardly through said tubular shroud.

6. The umbrella table, as described in claim 5, and further comprising an annular clip means mounted on said tubular shroud, and a transparent globe encircling said tubular shroud; and said globe having a lower end removably supported on said annular clip means.

7. The umbrella table, as described in claim 1, wherein one of said vertical rods is removable.

8. The umbrella table, as described in claim 7, wherein said lower disk has a first socket receiving the lower end of said one vertical rod, and said upper disk having a second socket receiving the upper end of said one vertical rod; said first socket having an internal rod support surface; said second socket having an internal roof surface; and said one rod having a length that is less than the vertical distance between said rod support surface and said roof surface, whereby said one rod can be removed by a lifting and tilting motion.

9. The umbrella table, as described in claim 1, wherein there are six circumferentially spaced vertical rods located equidistant from a central axis defined by said upper and lower tubes; said light source comprising a kerosene lamp having a kerosene fuel supply cup located in the upper end of said lower tube; and one of said vertical rods being removable to permit access to the kerosene lamp.

10. The umbrella table, as described in claim 9, and further comprising a transparent globe encircling said post structure; and said globe having a lower end adapted to rest on said table top and an upper end locatable above the plane of said upper disk whereby said globe is adapted to surround said circumferentially spaced rods.

11. The umbrella table, as described in claim 9, wherein said lower disk has a first socket receiving the lower end of said one vertical rod, and said upper disk has a second socket receiving the upper end of said one vertical rod; said first socket having an internal rod support surface; said second socket having an internal roof surface; said one rod having a length that is less than the vertical distance between said rod support surface and said roof surface, whereby said one rod can be removed by a lifting and tilting motion.

12. An umbrella table comprising a table top and a tubular guide extending downwardly from said top; and an upstanding post structure removably supported in said tubular guide; said post structure comprising a lower tube, an upper tube, and a cage located between said tubes; and a kerosene lamp disposed within said cage.

13. The umbrella table, as described in claim 12, wherein said cage is located a relatively slight distance above said table top; and said cage comprising an upper disk, a lower disk, and a plurality of vertical rods extending between said disks.

14. In an umbrella table that includes a table top, a tubular guide extending downwardly from said top, and an upstanding sectional post structure removably supported in said tubular guide, the improvement comprising:

an insert telescopically insertable between upper and lower sections of said post structure; said insert comprising a lower tube having an upper end, a lower disk radiating from the upper end of said lower tube, an upper tube having a lower end, an upper disk radiating from the lower end of said upper tube, and a plurality of vertical rods extending between said upper and lower disks; said rods circumscribing a central space aligned with said upper and lower tubes; and a light source located within said central space.

15. The improvement, as described in claim 14, wherein said light source is a kerosene lamp.

16. The improvement, as described in claim 14, wherein said light source is a kerosene lamp having a self-contained kerosene fuel supply.

17. The improvement, as described in claim 16, wherein said fuel supply is located in the upper end of said lower tube.

18. The improvement, as described in claim 17, wherein one of said vertical rods is removable; said lower disk having a first socket receiving the lower end of said one vertical rod, and said upper disk having a second socket receiving the upper end of said one vertical rod; said second socket having a vertical depth that is greater than the penetration depth of said one vertical rod, whereby said one vertical rod can be removed by a lifting and tilting motion.

19. The improvement, as described in claim 17, wherein one of said vertical rods is removable; said lower disk having a first socket receiving the lower end of said one vertical rod, and said upper disk having a second socket receiving the upper end of said one vertical rod; said first socket having an internal rod support surface; said second socket having an internal roof surface; said one rod having a length that is less than the vertical distance between said rod support surface and said roof surface, whereby said one rod can be removed by a lifting and tilting motion.

* * * * *